US007247131B2

(12) United States Patent
Belmann et al.

(10) Patent No.: US 7,247,131 B2
(45) Date of Patent: Jul. 24, 2007

(54) FOLDING MACHINE FOR THE GRAPHICS INDUSTRY

(75) Inventors: Markus Belmann, Kornwestheim/Pattonville (DE); Jürgen Kübler, Marbach (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 57 days.

(21) Appl. No.: 11/052,684

(22) Filed: Feb. 7, 2005

(65) Prior Publication Data

US 2005/0176570 A1 Aug. 11, 2005

(30) Foreign Application Priority Data

Feb. 6, 2004 (DE) ..... 10 2004 005 810

(51) Int. Cl.
*B31F 1/08* (2006.01)

(52) U.S. Cl. ..... 493/429; 493/424; 493/471; 493/475; 493/434

(58) Field of Classification Search ..... 493/405, 493/424, 425, 434, 435, 442, 471, 475, 476; 271/272
See application file for complete search history.

(56) References Cited

U.S. PATENT DOCUMENTS 3,841,621 A * 10/1974 Brown ..... 493/8
4,023,790 A 5/1977 Gortowski
4,099,710 A * 7/1978 Boyer et al. ..... 493/420
5,176,614 A 1/1993 Krasuski
5,980,444 A * 11/1999 Dickhoff ..... 493/433
6,840,898 B2 * 1/2005 Pettersson ..... 493/473
6,852,073 B2 * 2/2005 Neumann et al. ..... 493/435
2001/0049326 A1 12/2001 Neumann et al.

FOREIGN PATENT DOCUMENTS

DE 691 16 105 T2 5/1992
DE 101 22 113 A1 11/2001
DE 203 07 169 U1 8/2003

* cited by examiner

*Primary Examiner*—Hemant M. Desai
(74) *Attorney, Agent, or Firm*—Laurence A. Greenberg; Werner H. Stemer; Ralph E. Locher

(57) ABSTRACT

The invention relates to a folding machine for the graphics industry. The machine has a folder, at least one pair of blade shafts following the folder, and a separate roll frame that supports the pair of blade shafts. In order to be able to perform changeover operations on the pair of blade shafts as ergonomically as possible without partial dismantling of the folding machine, the folding machine is equipped with a guide for the roll frame and with an actuating device (e.g., tooth rack, pinion, crank) for displacing the roll frame along the guide.

4 Claims, 3 Drawing Sheets

FOLDING MACHINE FOR THE GRAPHICS INDUSTRY

BACKGROUND OF THE INVENTION

Field of the Invention

The invention relates to a folding machine for the graphics industry, comprising a folder, at least one pair of blade shafts following said folder, and a separate roll frame that supports the pair of blade shafts and can be displaced along a rectilinear guide.

A folding machine of this type is known, for example from the commonly assigned German patent application DE 101 22 113 A1 and U.S. patent application publication US 2001/0049326 A1. A separate roll frame disclosed thereby for supporting a second pair of blade shafts following a first pair of blade shafts has side walls with a special shape supporting the blade shafts of the latter pair. Side walls of the folding machine which support the first pair of blade shafts have recesses at the ends. The side walls of the roll frame supporting the second pair of blade shafts are provided with contours that correspond to those of the aforementioned recesses. The roll frame can to this extent be attached with an accurate fit to the side walls of the folding machine which support the first pair of blade shafts. The side walls of the roll frame in turn have recesses at the ends into which, during operation, a frame supporting a delivery roll and made of bearing plates connected to one another via cross-members is inserted. The delivery roll and, with it, the frame supporting the latter can be pivoted upward away from the second pair of blade shafts about an axis parallel to the delivery roll. To this extent, after the delivery roll has been pivoted away, said pair of blade shafts is accessible for adjustment work in the installed state.

German utility model (Gebrauchsmuster) DE 203 07 169 U1 discloses a folding machine having at least one pair of blade shafts, in which the blade shafts are mounted in a cartridge. The cartridge can be displaced through a side wall on the operator side from an insertion position into a withdrawal position. In this solution, sufficient space for the withdrawal of the cartridge is needed on the operator side.

SUMMARY OF THE INVENTION

It is accordingly an object of the invention to provide a folding machine, which overcomes the above-mentioned disadvantages of the heretofore-known devices and methods of this general type and which is improved in such as way that the pair of blade shafts saves space and is as accessible as possible for adjustment work without partial dismantling of the folding machine.

With the foregoing and other objects in view there is provided, in accordance with the invention, a folding machine, comprising:

a folder;

at least one pair of blade shafts following said folder in a product travel direction, and a separate roll frame supporting said pair of blade shafts;

a rectilinear guide assembly including a linear guide disposed at an incline and enabling said roll frame to be displaced therealong, and an actuating device for selectively displacing said roll frame along said rectilinear guide.

In a preferred rising arrangement of the guide, in any case during the operation of the folding machine, the pair of blade shafts is located in a lower region of the rising guide. For adjustment work on the pair of blade shafts, said pair can be moved along the guide into an ergonomically beneficial elevated position.

The guide is preferably constructed as a rectilinear guide and, in a preferred exemplary embodiment, comprises a rack, with which a pinion rotatably mounted in the roll frame meshes.

In an alternative refinement, the guide is implemented, for example, by means of a spindle drive.

A further alternative results from a guide in the form of a pure sliding guide and from an exemplary construction of the actuating means in the form of a piston-cylinder unit.

Other features which are considered as characteristic for the invention are set forth in the appended claims.

Although the invention is illustrated and described herein as embodied in a folding machine for the graphics industry, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
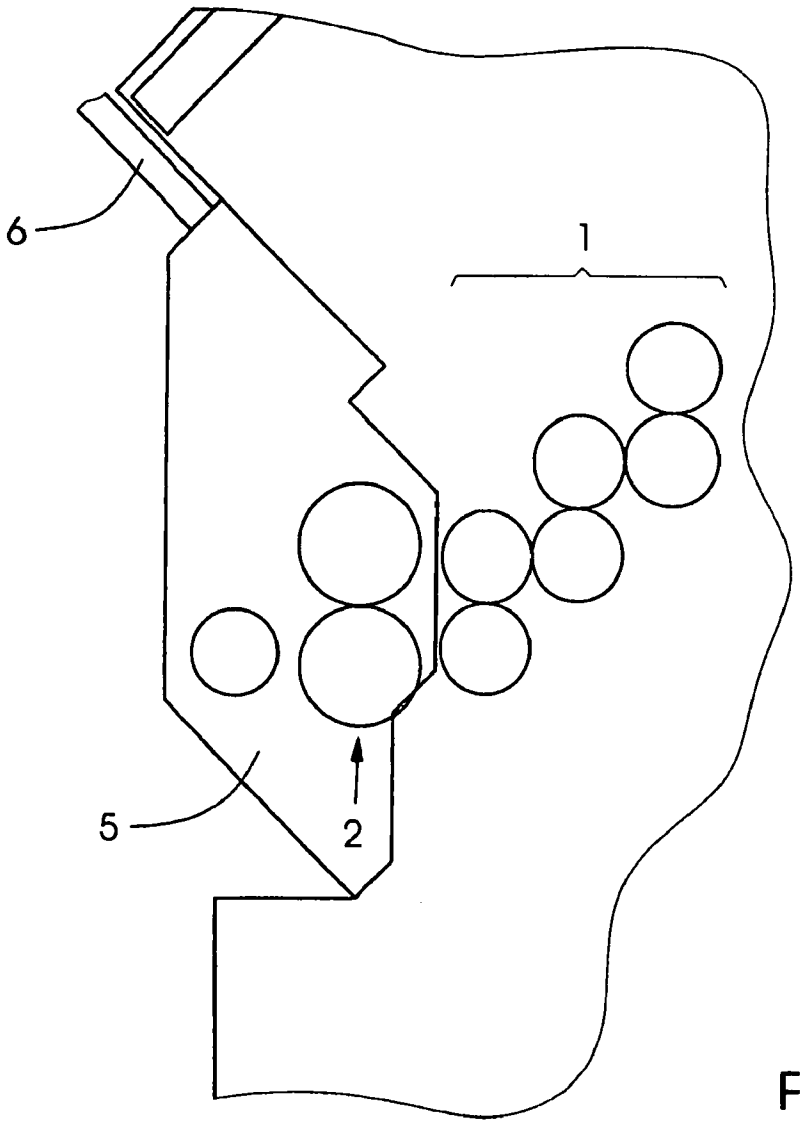
FIG. 1 is a schematic side view of a folding machine having a plurality of folding rolls following one another for jaw folders, and a pair of blade shafts, following them on the left in the figure, which pair is mounted in a separate roll frame that, in turn, can be displaced along a stationary guide.

Referring now to the figures of the drawing in detail and first, particularly, to FIG. 1 thereof, there is shown an exemplary embodiment of a folding machine according to the invention. The folding machine 1 is a jaw folder for producing multiply folded signatures. The folds are effected by a folding roll configuration 1 and folding jaws associated therewith. The folding jaws are not illustrated herein for reasons of clarity. A plurality of folders are provided. The last of these folders is followed by a pair of blade shafts 2, which is mounted in a separate roll frame 5.

The roll frame 5 can be displaced along a guide 6. In the refinement illustrated, the latter is preferably arranged so as to rise and, for example, is fixed at the end to the side walls supporting the folding roll configuration 1.

Figure 2:
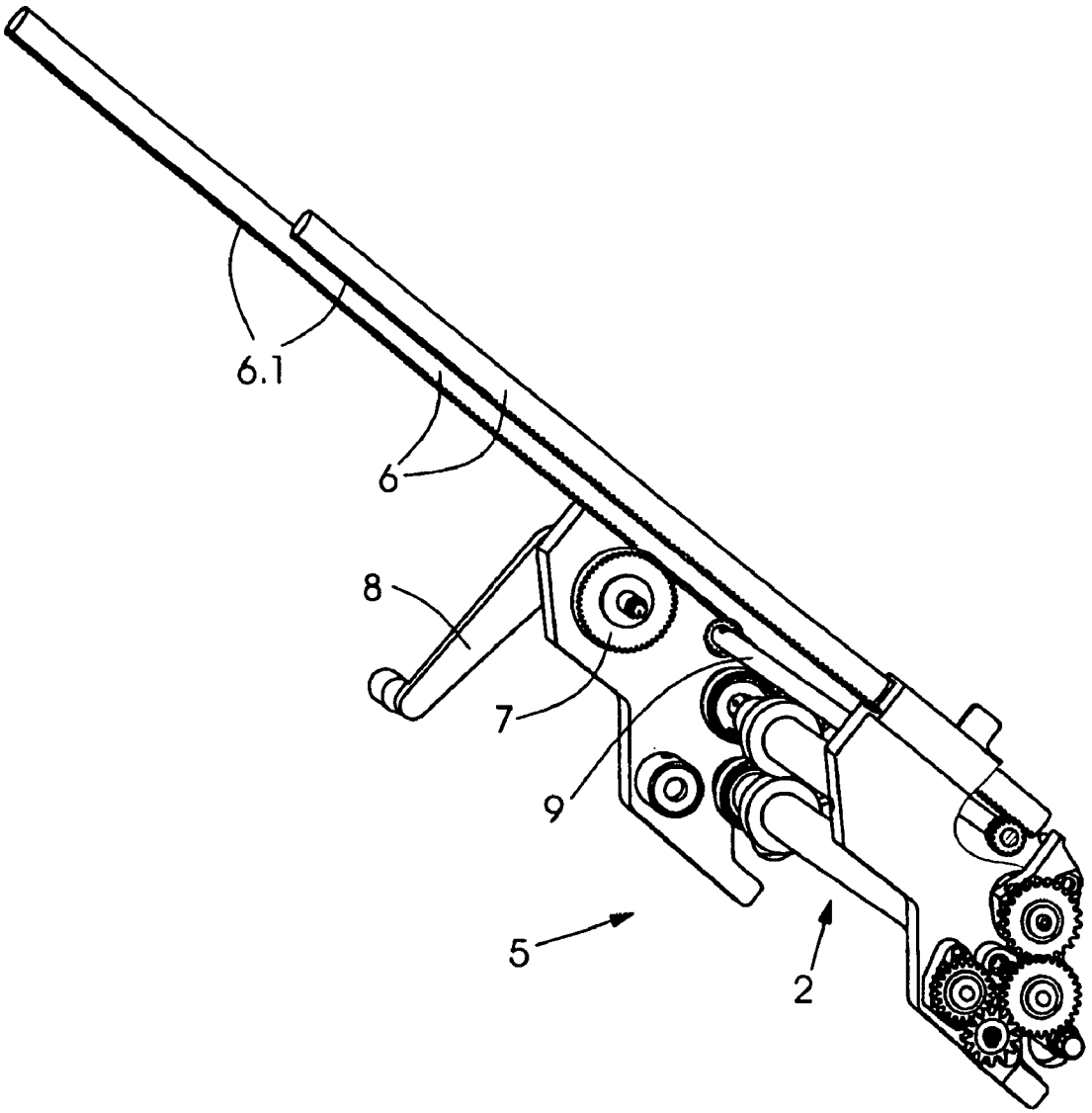
FIG. 2 is a perspective view of the linear guide assembly and of the roll frame, reproducing the installed position.

FIG. 2 illustrates an actuating device or actuating means that are provided to displace the roll frame 5 along the guide 6. These comprise a rack toothing system 6.1 or a tooth rack 6.1 provided on the guide 6, preferably constructed as a linear guide (also referred to as a rectilinear guide, a slide bar, or a straight guide), and a pinion 7 which meshes herewith and is mounted in the roll frame 5 and which, in the exemplary embodiment illustrated, can be set rotating by way of a hand crank 8.

The guide 6 preferably comprises two racks or tooth rods, of which a respective one is assigned to a respective side wall of the roll frame 5. To this extent, this permits displacement of the roll frame 5 without the latter tilting, since gears rolling synchronously on the two racks are mounted in the two side walls of the roll frame 5. In an advantageous embodiment, this is implemented in that a drive shaft that is common to two gears and that can be set rotating by means of the hand crank 8 is mounted in the two side walls of the roll frame 5 and a respective one of these gears meshes with one of the two rack toothing systems.

FIG. 2 shows an alternative configuration to this in which a pinion 7 is rotatably mounted in only one side wall of the roll frame and can be set rotating, here by means of the hand crank 8. In this case, a synchronizing shaft 9 firmly connected to two gears so as to rotate with them is additionally mounted in a respective side wall of the roll frame 5, a respective one of the gears of the synchronizing shaft 9 meshing with one of the two racks.

In the position of the roll frame illustrated in FIG. 2, at the lower end of the rising guide 6, the pair of blade shafts 2 is located in a working position illustrated in FIG. 1. In particular for changeover operations on the pair of blade shafts 2, the roll frame 5 is displaced into an ergonomically beneficial, elevated position at the upper end of the guide 6 by means of appropriate activation of the actuating means, the hand crank 8 in the exemplary embodiment illustrated, and is locked there by conventional locking means, for example an index hole and index pin.

In the event of manual displacement of the roll frame 5 by means of the introduction of force via the hand crank 8, provided by way of example, an effective force accumulator is preferably provided between the roll frame 5 and the pinion 7 and applies a substantial part of the force necessary to raise the roll frame 5. In a preferred exemplary embodiment, the force accumulator is constructed in the form of a spiral spring and, in a prestressed state of the latter, is fixed at one end to the pinion 7 or a side wall of the roll frame 5 supporting a stub shaft firmly connected to said pinion so as to rotate with it, and at the other end to the afore-mentioned stub shaft.

Figure 3:
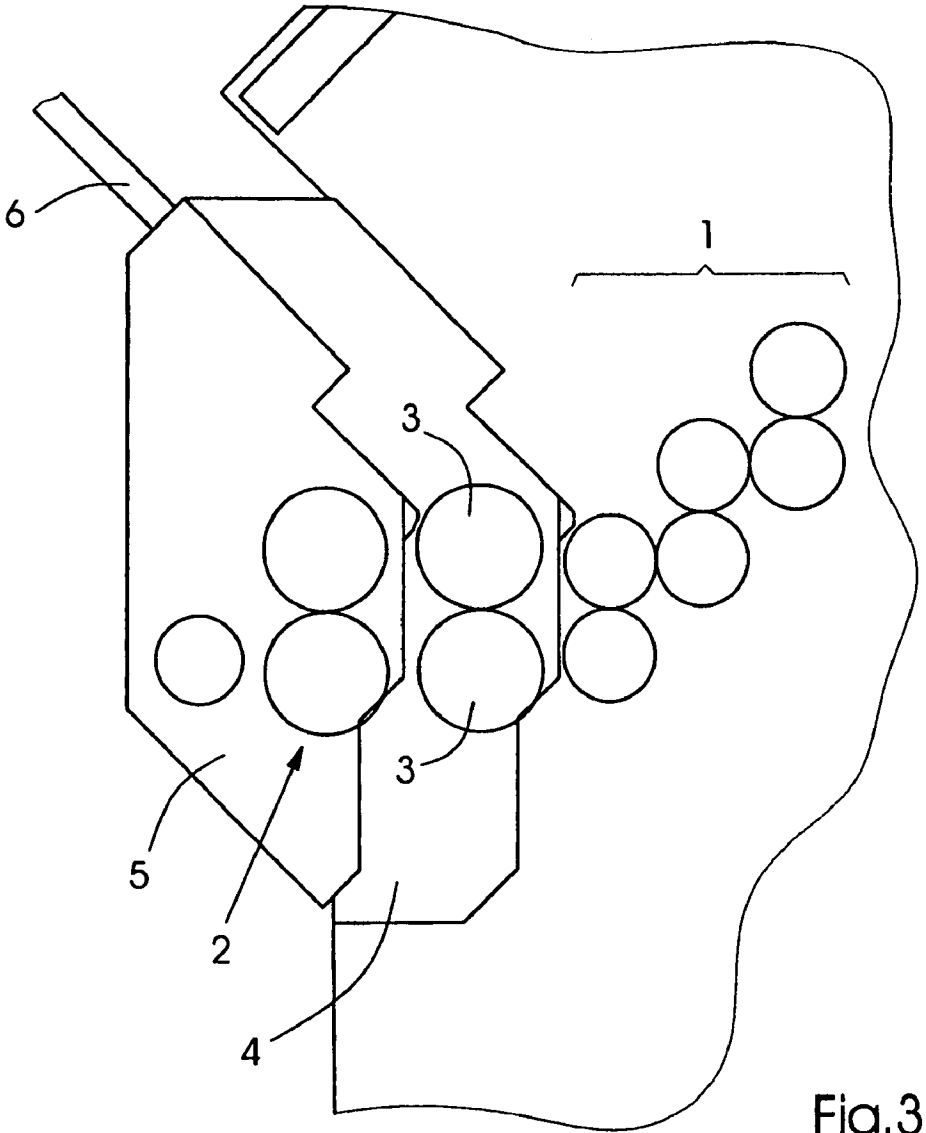
FIG. 3 is a schematic side view of a folding machine again having a plurality of folding rolls following one another for jaw folders, a blade shaft module, following them on the left in the figure, having a pair of blade shafts and a pair of blade shafts again following them on the left, which pair is mounted in a separate roll frame that, in turn, can be displaced along a stationary guide.

FIG. 3 shows an exemplary embodiment of a folding machine in which a blade shaft module 4 comprising a pair of blade shafts 3 and following the folding roll configuration 1 is mounted in front of the pair of blade shafts 2 according to FIG. 1. In this case, the guide 6 is, for example, fixed at the ends to side walls of the blade shaft module 4.

In a folding machine configured in this way, the displaceable configuration of the roll frame 5 provides the further advantage of the accessibility of the blade shaft 3 of the blade shaft module 4 when the roll frame 5 is displaced along the guide 6.

This application claims the priority, under 35 U.S.C. § 119, of German patent application No. 10 2004 005 810.5, filed Feb. 6, 2004; the entire disclosure of the prior application is herewith incorporated by reference.

We claim:

1. A folding machine, comprising:

a folder;

at least one pair of blade shafts following said folder in a product travel direction, and a separate roll frame supporting said pair of blade shafts;

a rectilinear guide assembly including a linear guide disposed at an incline and enabling said roll frame to be displaced therealong, arid an actuating device for selectively displacing said roll frame along said rectilinear guide; and a rack toothing system formed on said linear guide and a pinion meshing with said rack toothing system rotatably mounted in said roll frame.

2. The folding machine according to claim 1, wherein said linear guide comprises two racks each assigned to a respective Bide wall of said roll frame.

3. The folding machine according to claim 1, wherein said rectilinear guide assembly is a spindle drive.

4. The folding machine according to claim 1, wherein said linear guide is a sliding guide and said actuating device is a piston-cylinder unit.

* * * * *

UNITED STATES PATENT AND TRADEMARK OFFICE

CERTIFICATE OF CORRECTION

PATENT NO. : 7,247,131 B2
APPLICATION NO. : 11/052684
DATED : July 24, 2007
INVENTOR(S) : Markus Belmann et al.

It is certified that error appears in the above-identified patent and that said Letters Patent is hereby corrected as shown below:

Column 4,

Line 28, “arid” should read -- and --

Line 37, “Bide” should read -- side --

Signed and Sealed this

Sixth Day of November, 2007

JON W. DUDAS
*Director of the United States Patent and Trademark Office*